US010204545B2

(12) United States Patent
Park

(10) Patent No.: US 10,204,545 B2
(45) **Date of Patent: *Feb. 12, 2019**

(54) GATE DRIVER AND DISPLAY DEVICE INCLUDING THE SAME

(71) Applicant: Samsung Display Co., Ltd., Yongin-si, Gyeonggi-Do (KR)

(72) Inventor: Su-Hyeong Park, Gyeongju-si (KR)

(73) Assignee: Samsung Display Co., Ltd. (KR)

( * ) Notice: Subject to any disclaimer, the term of this patent is extended or adjusted under 35 U.S.C. 154(b) by 103 days.

This patent is subject to a terminal disclaimer.

(21) Appl. No.: 15/394,004

(22) Filed: Dec. 29, 2016

(65) Prior Publication Data

US 2017/0186363 A1 Jun. 29, 2017

(30) Foreign Application Priority Data

Dec. 29, 2015 (KR) ..... 10-2015-0188366

(51) Int. Cl.
*G09G 3/20* (2006.01)
*G09G 3/3266* (2016.01)

(52) U.S. Cl.
CPC ..... *G09G 3/2092* (2013.01); *G09G 3/3266* (2013.01); *G09G 2310/0286* (2013.01); *G09G 2310/0291* (2013.01); *G09G 2310/08* (2013.01)

(58) Field of Classification Search
CPC combination set(s) only.
See application file for complete search history.

(56) References Cited

U.S. PATENT DOCUMENTS

| | | | | |
|---|---|---|---|---|
| 9,786,384 | B2 * | 10/2017 | Lee | G11C 19/287 |
| 9,837,017 | B2 * | 12/2017 | Park | G09G 3/3208 |
| 2015/0170568 | A1 * | 6/2015 | Lee | G09G 3/3233 345/690 |
| 2015/0364083 | A1 * | 12/2015 | Jeon | G09G 3/3233 345/76 |
| 2016/0351160 | A1 * | 12/2016 | In | G09G 3/3225 |

FOREIGN PATENT DOCUMENTS

| | | | |
|---|---|---|---|
| KR | 10-2008-0001856 | A | 1/2008 |
| KR | 10-2012-0019227 | A | 3/2012 |
| KR | 10-2014-0052454 | A | 5/2014 |
| KR | 10-2015-0002135 | A | 1/2015 |
| KR | 10-2015-0006732 | A | 1/2015 |
| KR | 10-2015-0049121 | A | 5/2015 |
| KR | 10-2015-0142708 | A | 12/2015 |
| KR | 10-2016-0095231 | A | 8/2016 |
| KR | 10-2016-0141132 | A | 12/2016 |

* cited by examiner

*Primary Examiner* — Van N Chow
(74) *Attorney, Agent, or Firm* — Innovation Counsel LLP

(57) ABSTRACT

A gate driver includes stages configured to output gate signals and gate initialization signals. Here, an Nth stage includes a first output block configured to generate an Nth carry signal based on an N−1th carry signal and to generate an Nth gate initialization signal based on the N−1th carry signal, an output enable signal, and an output disable signal that is an inverted signal of the output enable signal; and a second output block configured to generate an Nth gate signal by shifting the Nth gate initialization signal by a horizontal time, where N is a positive integer.

20 Claims, 8 Drawing Sheets

GATE DRIVER AND DISPLAY DEVICE INCLUDING THE SAME

CROSS-REFERENCE TO RELATED APPLICATION(S)

This application claims priority under 35 USC § 119 to Korean Patent Application No. 10-2015-0188366, filed on Dec. 29, 2015 in the Korean Intellectual Property Office (KIPO), the contents of which are incorporated herein in its entirety by reference.

BACKGROUND

1. Technical Field

Example embodiments relate to a display device. More particularly, embodiments of the present inventive concept relate to a gate driver and a display device including a gate driver.

2. Description of the Related Art

A display device includes a display panel and a display panel driver. The display panel includes gate lines, data lines, and pixels. The display panel driver includes a gate driving circuit and a data driving circuit. The gate driving circuit includes stages to simultaneously or sequentially output a gate signal, a gate initialization signal, and an anode initialization signal for an organic light emitting element, etc.

Recently, a technique of driving the display panel has been in progress to provide the gate signal to a portion of the display panel for a low power driving or a partial driving of the display panel. For example, the technique divides the stages into blocks and provides a frame start signal for each of the blocks. By controlling the frame start signal, the gate signal is controlled for each of the blocks. However, the technique does not control the gate signal to be on or off for each of gate lines, and the number of frame start signals is equal to the number of gate lines for a line-by-line control of the gate signal.

SUMMARY

Some example embodiments provide a gate driver to selectively or partially output gate signals and gate initialization signals.

Some example embodiments provide a display device including the gate driver.

According to example embodiments, a gate driver may include stages to output gate signals and gate initialization signals. Here, an Nth stage may include a first output block to generate an Nth carry signal based on an N−1th carry signal and to generate an Nth gate initialization signal based on the N−1th carry signal, an output enable signal, and an output disable signal that is an inverted signal of the output enable signal; and a second output block to generate an Nth gate signal by shifting the Nth gate initialization signal by a horizontal time, where N is a positive integer.

In an example embodiment, the stages may selectively output the gate signals and the gate initialization signals based on the output enable signal and the output disable signal.

In an example embodiment, the first output block may include a first node controller transferring the N−1th carry signal or a first direct current (DC) voltage to a first node based on a first clock signal and a second clock signal; a second node controller transferring the a second DC voltage or the first clock signal to a second node based on the first clock signal and a signal of the first node, the second DC voltage being lower than the first DC voltage; a first output buffer outputting the Nth carry signal based on a signal of the first node and a signal of the second node; an output controller transferring a signal of the first node to a third node based on the output enable signal and transferring a signal of the second node to a fourth node based on the output enable signal; and a second output buffer outputting the Nth gate initialization signal based on a signal of the third node and a signal of the fourth node.

In an example embodiment, the output controller may initialize the third node and the fourth node based on the output disable signal.

In an example embodiment, the output controller may provide the first DC voltage to the third node and provide the second DC voltage to the fourth node when the output disable signal has a logic low level.

In an example embodiment, the output controller may include a first control switching element including a gate electrode receiving the output disable signal, a first electrode receiving the first DC voltage, and a second electrode electrically connected to the third node; and a second control switching element including a gate electrode receiving the output disable signal, a first electrode receiving the second DC voltage, and a second electrode electrically connected to the fourth node.

In an example embodiment, the Nth stage may skip the output of the Nth gate initialization signal and the Nth gate signal in response to the output disable signal having a logic low level.

In an example embodiment, the output controller may include a third control switching element electrically connecting the first node and the third node based on the output enable signal; and a fourth control switching element electrically connecting the second node and the fourth node based on the output enable signal.

In an example embodiment, the output controller may include a third capacitor electrically connected between an output terminal of the first output buffer and the third node.

In an example embodiment, the first output buffer may include a first pull-up switching element including a gate electrode electrically connected to the second node, a first electrode receiving a pull-up voltage, and a second electrode electrically connected to an output terminal that outputs the Nth carry signal; and a first pull-down switching element including a gate electrode electrically connected to the first node, a first electrode electrically connected to the output terminal, and a second electrode receiving the second clock signal.

In an example embodiment, the second output buffer may include a second pull-up switching element including a gate electrode electrically connected to the fourth node, a first electrode receiving a pull-up voltage, and a second electrode electrically connected to an output terminal that outputs the Nth gate initialization signal; and a second pull-down switching element including a gate electrode electrically connected to the third node, a first electrode electrically connected to the output terminal, and a second electrode receiving the second clock signal.

In an example embodiment, the N−1th carry signal may be a frame start signal.

According to example embodiments, a gate driver may include stages to output gate signals and gate initialization signals. Here, an Nth stage may include a first output block to generate a 2N−1th carry signal based on a 2N−3th carry signal and to generate a 2N−1th gate initialization signal based on the 2N−3th carry signal, an output enable signal, and an output disable signal that is an inverted signal of the output enable signal; and a second output block to generate a 2N−1th gate signal by shifting the 2N−1th gate initialization signal by a horizontal time and to generate a 2N gate signal by shifting the 2N−1th gate signal by a horizontal time, where N is a positive integer.

In an example embodiment, the stages may selectively output the gate signals and the gate initialization signals based on the output enable signal and the output disable signal.

In an example embodiment, the second output block may output a 2N gate initialization signal that is the same as the 2N−1th gate signal.

In an example embodiment, the second output block may include a first sub output block generating the 2N−1th gate signal by shifting the 2N−1th gate initialization signal by a horizontal time; and a second sub output block generating the 2Nth gate signal by shifting the 2N−1th gate signal by a horizontal time.

In an example embodiment, the first output block may include a first node controller transferring the 2N−3th carry signal or a first direct current (DC) voltage to a first node based on a first block clock signal and a second block clock signal; a second node controller transferring a second DC voltage or the first block clock signal to a second node based on the first block clock signal and a signal of the first node, the second DC voltage being lower than the first DC voltage; a first output buffer outputting the 2N−1th carry signal based on a signal of the first node and a signal of the second node; an output controller transferring a signal of the first node to a fourth node based on the output enable signal and transferring a signal of the second node to a third node based on the output enable signal; and a second output buffer outputting the 2N−1th gate initialization signal based on a signal of the third node and a signal of the fourth node.

In an example embodiment, the output controller may provide the first DC voltage to the third node and provide the second DC voltage to the fourth node in response to the output disable signal having a logic low level.

In an example embodiment, the Nth stage may skip the output of the 2N−1th and 2Nth gate initialization signals and the 2N−1th and 2Nth gate signals in response to the output disable signal having a logic low level.

According to example embodiments, a display device may include a display panel including pixels; a data driver configured to provide data signals to the display panel through data lines; and a gate driver including stages to provide gate signals and gate initialization signals to the display panel through gate lines and gate initialization lines. Here, an Nth stage may include a first output block to generate an Nth carry signal based on an N−1th carry signal and to generate an Nth gate initialization signal based on the N−1th carry signal, an output enable signal, and an output disable signal that is an inverted signal of the output enable signal; and a second output block to generate an Nth gate signal by shifting the Nth gate initialization signal by a horizontal time, where N is a positive integer.

Therefore, a gate driver according to example embodiments may selectively skip some gate initialization signal and some gate signals by including a first output block, which generates a carry signal and which selectively outputs a gate initialization signal based on an output enable signal and an output disable signal, and a second output block, which outputs a gate signal dependently to the gate initialization signal. That is, the gate driver may easily control gate signals (and gate initialization signal) to be or not to be provided to a display panel line-by-line.

In addition, a display device according to example embodiments may reduce power consumption by partially driving a display panel, by partially displaying an image and reducing an output swing frequency of a data driver according to a change of an image.

BRIEF DESCRIPTION OF THE DRAWINGS

Illustrative, non-limiting example embodiments will be more clearly understood from the following detailed description taken in conjunction with the accompanying drawings.

DESCRIPTION OF EMBODIMENTS

Hereinafter, the present inventive concept will be explained in detail with reference to the accompanying drawings.

Figure 1:
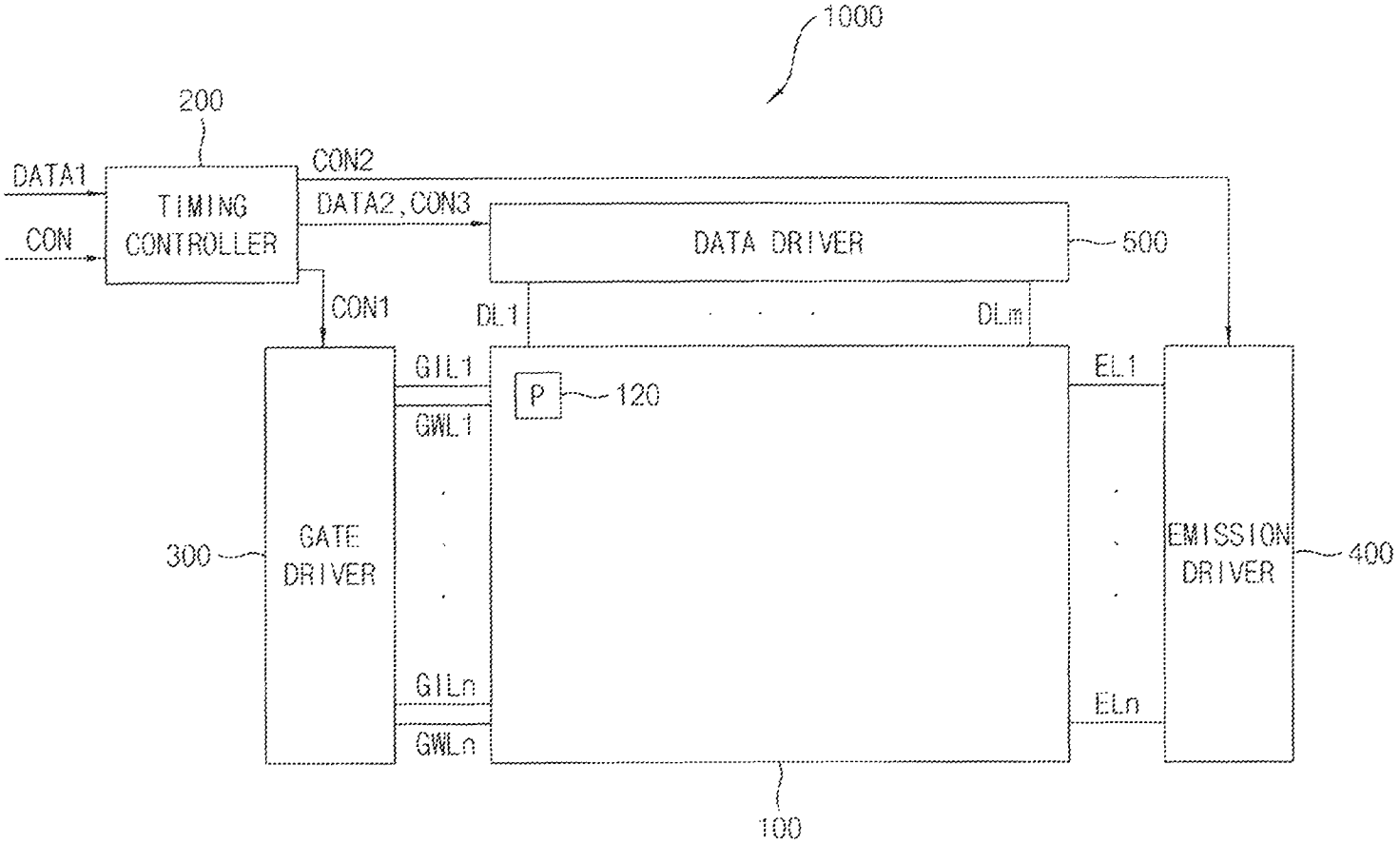
FIG. 1 is a block diagram illustrating a display device according to example embodiments.

FIG. 1 is a block diagram illustrating a display device according to example embodiments.

Referring to FIG. 1, the display device 1000 may include a display panel 100, a timing controller 200, a gate driver 300, and a data driver 500. The display device 1000 may further include an emission driver 400. For example, the display device 1000 may be an organic light emitting display device.

The display panel 100 may display an image. The display panel 100 may include gate lines GWL1 through GWLn, gate initialization lines GIL1 through GILn, data lines DL1 through DLm, and pixels 120, where each of m and n is an integer greater than or equal to 2. The pixels 120 may be electrically connected to the gate lines GWL1 through GWLn, the gate initialization lines GIL1 through GILn, and the data lines DL1 through DLm. For example, the pixels 120 may be arranged in a matrix format, and a number of the pixels 120 may be a multiplication of n and m (e.g., n*m).

The timing controller 200 may control the gate driver 300, the emission driver 400, and the data driver 500. The timing controller 200 may receive an input control signal CON and an input image signal DATA1 from an image source such as an external graphic device. The timing controller 200 may generate a data signal DATA2 in a digital format that is suitable for the display panel 100 based on the input image signal DATA1 and may provide the data signal DATA2 to the data driver 500. In addition, the timing controller 200 may generate a first control signal CON1 to control a driving timing of the gate driver 300 based on the input control signal CON, a second control signal CON2 to control a driving timing of the emission driver 400, and a third control signal CON3 to control a driving timing of the data driver 500 and may provide the control signals CON1 through CON3 to the gate driver 300, the emission driver 400, and the data driver 500, respectively.

In an example embodiment, the timing controller 200 may control an output enable signal and an output disable signal and provide these signals to the gate driver 300.

The gate driver 300 may respectively output the gate signals and gate initialization signals to the display panel 100 through the gate lines GWL1 through GWLn and the gate initialization signal lines GIL1 through GILn. The gate driver 300 may output the gate signals and gate initialization signals based on the first control signal CON1 provided from the timing controller 200.

In some example embodiments, the gate driver 300 may include stages that output the gate signals and the gate initialization signals. The gate driver 300 may receive a first clock signal, a second clock signal, an output enable signal and an output disable signal from the timing controller 200. The gate driver 300 may selectively output (or, skip) the gate signals and the gate initialization signals based on the output enable signal and the output disable signal. Therefore, the pixels that are electrically connected to selected gate initialization lines and gate lines dependent on the gate initialization lines may receive the gate initialization signals and the gate signals. In an example embodiment, the gate driver 300 may include PMOS (P-channel Metal Oxide Semiconductor) transistors and may be included in the display panel 100.

In example embodiments, the gate driver 300 may include an Nth stage, and the Nth stage may include a first output block and a second output block, where N is a positive integer.

The first output block may generate an Nth carry signal based on an input signal. Here, the input signal may be the frame start signal or a carry signal (e.g., an N−1th carry signal) generated by a previous stage (e.g., an N−1th stage). In addition, the first output block may generate an Nth gate initialization signal based on the input signal (or, the N−1th carry signal), the output enable signal, and the output disable signal. The second output block may receive the Nth gate initialization signal and may generate the Nth gate signal, which is shifted by a horizontal time (or, a predetermined time period), based on the Nth gate initialization signal. That is, the second output block may generate the Nth gate signal by shifting the Nth gate initialization signal by a horizontal time.

The emission driver 400 may output light emission control signals to the display panel 100 through the light emission control lines EL1 through ELn. The emission driver 400 may sequentially output the light emission control signals to the light emission control lines EL1 though ELn based on the second control signal CON2 provided from the timing controller 200, for each frame.

The data driver 500 may convert the data signal DATA2 provided from the timing controller 200 into a data voltage in an analog format based on the third control signal CON3 provided from the timing controller 200 and may provide (or apply) the data voltage to the data lines DL1 through DLm.

As described above, the display device 1000 may selectively update an image for each pixel row by including the gate driver 300, which selectively outputs the gate initialization signal and the gate signal based on the output enable signal and the output disable signal. Therefore, a frequency of an output swing of the data driver according to an image change may be reduced, and power consumption may be reduced (or decreased).

Figure 2:
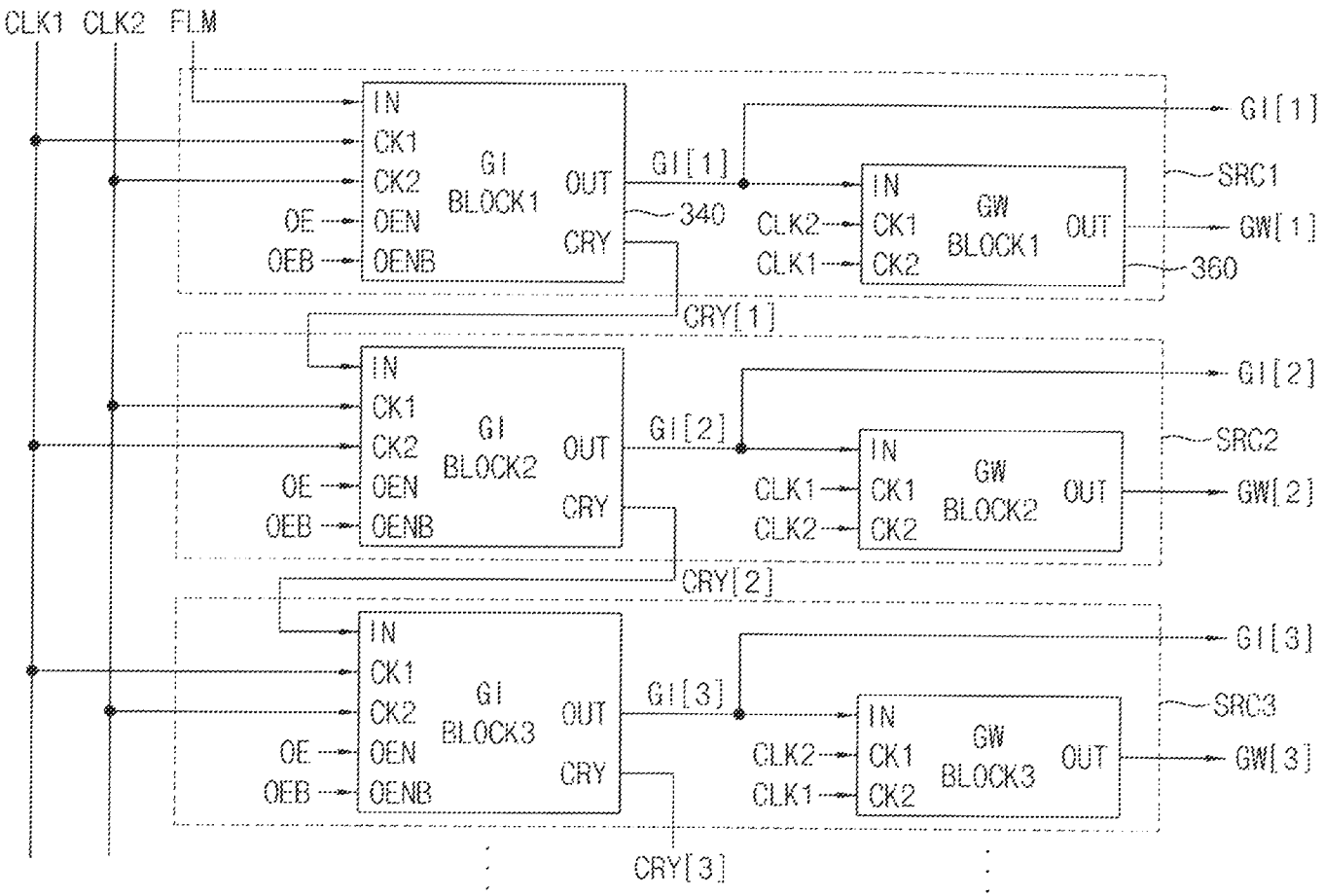
FIG. 2 is a diagram illustrating an example of a gate driver included in the display device of FIG. 1.

FIG. 2 is a diagram illustrating an example of a gate driver included in the display device of FIG. 1.

Referring to FIGS. 1 and 2, the gate driver 300 may include stages SRC1, SRC2, and SRC3, which are electrically connected to each other.

The stages SRC1, SRC2, and SRC3 may be electrically connected to the gate initialization lines and the gate lines and may output the gate initialization signals GI1, GI2, and GI3 and the gate signals GW1, GW2, and GW3.

Each of the stages SRC1, SRC2, and SRC3 may include a first output block 340 and a second output block 360. Each of the first output block 340 and the second output block 360 may include an input terminal IN, a first clock terminal CK1, a second clock terminal CK2, and an output terminal OUT. The first output block 340 may further include an enable terminal OEN, a disable terminal OENB, and a carry terminal CRY. Though not shown, the first output block 340 and the second output block 360 may further include terminals that receive a first direct current (DC) voltage and a second DC current having a voltage level less than a voltage level of the first DC voltage.

A first clock signal CLK1 and a second clock signal CLK2 may be provided to the first output block 340 and the second output block 360. Here, the first clock signal CLK1 may have a period that is the same as a period of the second clock signal CLK2, and the second clock signal CLK2 may be shifted by a half period (e.g., by a horizontal time) of the first clock signal CLK1 with respect to the first clock signal CLK1. The first clock signal CLK1 and the second clock signal CLK2 may be provided to an adjacent stage in reverse.

For example, the first clock signal CLK1 and the second clock signal CLK2 may be provided to the first clock terminal CK1 and the second clock terminal CK2 of the first output block 340 of an odd-numbered stage SRC1 and SRC3, respectively. Here, the second clock signal CLK2 and the first clock signal CLK1 may be provided to the first clock terminal CK1 and the second clock terminal CK2 of the first output block 340 of an even-numbered stage SRC2, respectively. Similarly, the second clock signal CLK2 and the first clock signal CLK1 may be respectively provided to the first clock terminal CK1 and the second clock terminal CK2 of the second output block 360 of the odd-numbered stage SRC1 and SRC3, and the first clock signal CLK1 and the second clock signal CLK2 may be respectively provided to the first clock terminal CK1 and the second clock terminal CK2 of the second output block 360 of the even-numbered stage SRC2.

The first output block 340 may output a carry signal based on an input signal, e.g., FLM, CRY[1], CRY[2], or CRY[3]. The frame start signal FLM or a carry signal of a previous stage (e.g., CRY[1], CRY[2], and CRY[3]) may be provided to the input terminal IN of the first output block 340. That is, the frame start signal FLM may be provided to the input terminal IN of the first output block 340 of the first stage SRC1, and the carry signal of the previous stage may be provided to the input terminal IN of the first output block 340 of the second through Nth stages. The carry terminal CRY of the first output block 340 of each stage may output a carry signal (e.g., CRY[1], CRY[2], CRY[3]) to the input terminal IN of the first output block 340 of a next stage (or a rear stage). For example, the carry signals CRY[1] and CRY[3] output from the carry terminal CRY of the first output block 340 of the odd-numbered stages SRC1 and SRC3 may be output during a low period of the second clock signal CLK2 (or during a logic low period in which the second clock signal CLK2 has a logic low level). For example, the carry signal CRY[2] output from the carry terminal CRY of the first output block 340 of the even-numbered stage SRC2 may be output during a low period of the first clock signal CLK1.

In addition, the first output block 340 may output a gate initialization signal (e.g., GI[1], GI[2], and GI[3]) based on the input signal (e.g., FLM, CRY[1], CRY[2], CRY[3]), the output enable signal OE, and the output disable signal OEB. The output disable signal OEB may be an inverted signal of the output enable signal OE. The output enable signal OE and the output disable signal OEB may be provided to the stages SRC1, SRC2, and SRC3 in common. The output terminal OUT of the first output block 340 may output the gate initialization signal (e.g., GI[1], GI[2], and GI[3]) to the second block 360 of the same stage and the gate initialization lines. For example, in the output terminal OUT of the first output block 340 of the odd-numbered stages SRC1 and SRC3, the gate initialization signals GI[1] and GI[3] may be output during the low period of the second clock signal CLK2. For example, in the output terminal OUT of the first output block 340 of the even-numbered stage SRC2, the gate initialization signal GI[2] may be output during the low period of the first clock signal CLK1. Here, the first output block 340 may output no gate initialization signal during a high level period of the output enable signal OE (or during a low level period of the output disable signal OEB).

The second output block 360 may receive the initialization signal (e.g., GI[1], GI[2], and GI[3]) and may output the gate signal (e.g., GW[1], GW[2], and GW[3]), which is shifted by a horizontal time with respect to the gate initialization signal (e.g., GI[1], GI[2], and GI[3]). The initialization signal (e.g., GI[1], GI[2], and GI[3]) may be provided to The input terminal IN of the second output block 360. The output terminal OUT of the second output block 360 may output the gate signal (e.g., GW[1], GW[2], and GW[3]) to the gate line. For example, the output terminal OUT of the second output block 360 of the odd-numbered stages SRC1 and SRC3 may output the gate signals GW[1] and GW[3] during the low period of the first clock signal CLK1. For example, the output terminal OUT of the second output block 360 of the even-numbered stage SRC2 may output the gate signal GW[2] during the low period of the second clock signal CLK2. Therefore, the gate signal (e.g., GW[1], GW[2], and GW[3]) that is outputted may be shifted by a horizontal time with respect to the gate initialization signal (e.g., GI[1], GI[2], and GI[3]). Because the second block 360 outputs the gate signal dependently on the gate initialization signal, the second block 360 may not output a gate signal when the first block 340 does not output a gate initialization signal.

Figure 3:
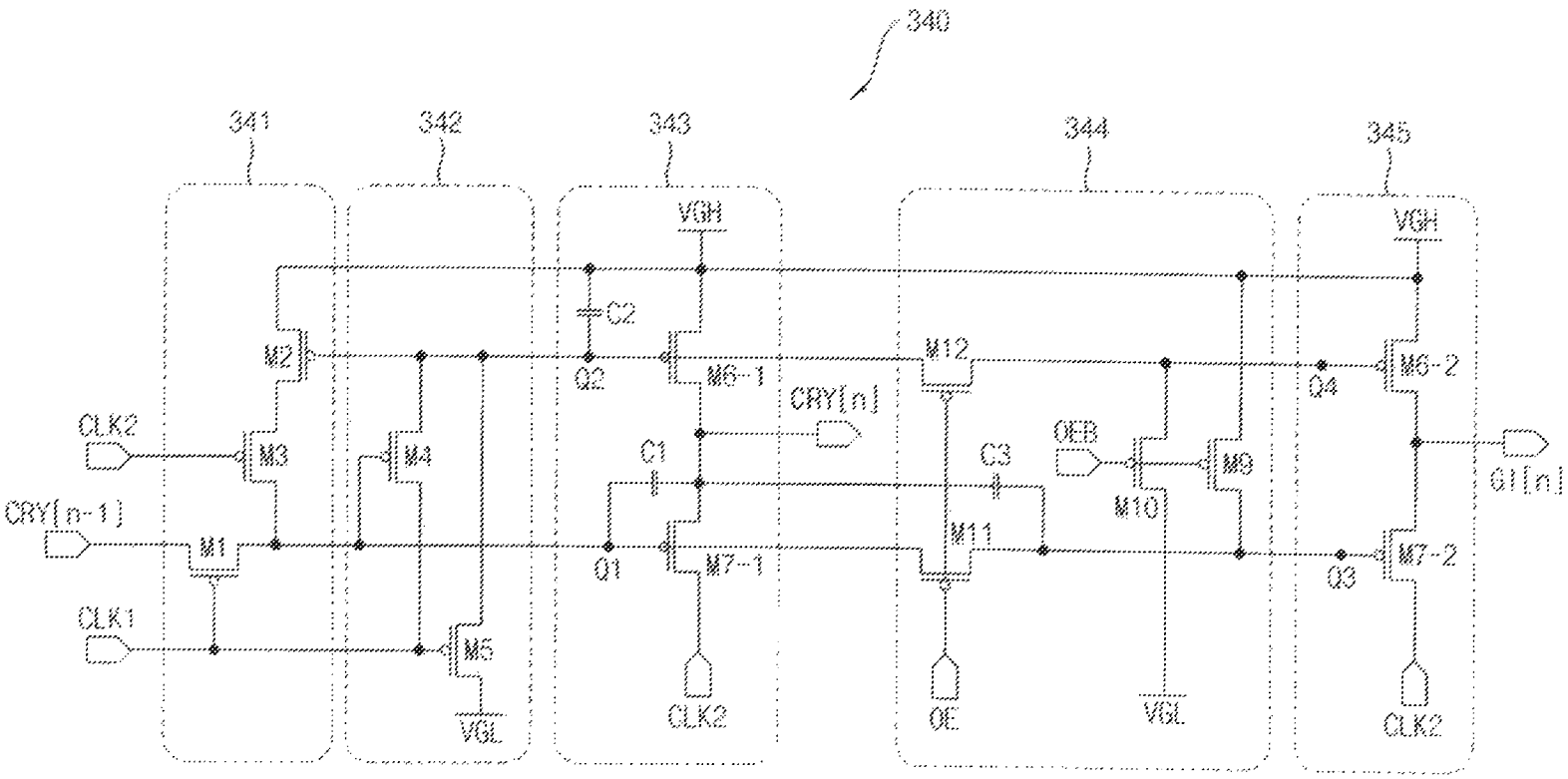
FIG. 3 is a circuit diagram illustrating an example of a first output block included in the gate driver of FIG. 2.

FIG. 3 is a circuit diagram illustrating an example of a first output block included in the gate driver of FIG. 2.

Referring to FIGS. 2 and 3, the first output block 340 of the Nth stage may include a first node controller 341, a second node controller 342, a first output buffer 343, an output controller 344, and a second output buffer 345.

Hereinafter, a display device 1000 and the gate driver 300 having a PMOS transistor are described by way of an example. The display device 1000 and the gate driver 300 are not limited thereto. For example, the gate driver 300 may include an NMOS (N-channel Metal Oxide Semiconductor).

The first node controller 341 may transfer the N−1th carry signal CRY[n−1] or a first DC voltage VGH to a first node Q1 based on the first and second clock signals CLK1 and CLK2. The first node controller 342 may include a first switching element M1, a second switching element M2, and a third switching element M3.

The first switching element M1 may include a gate electrode receiving the first clock signal CLK1, a first electrode receiving the N−1th carry signal CRY[n−1], and a second electrode electrically connected to the first node Q1. Here, the first electrode may be a source electrode, and the second electrode may be a drain electrode. The second switching element M2 may include a gate electrode receiving a signal of the second node Q2, a first electrode receiving the first DC voltage VGH, and a second electrode providing the first DC voltage VGH to the first node Q1. The third switching element M3 may include a gate electrode receiving the second clock signal CLK2, a first electrode electrically connected to the second electrode of the second switching element M2, and a second electrode electrically connected to the first node Q1. Here, the second and third switching elements M2 and M3 may be electrically connected in series.

The second node controller 342 may transfer the first clock signal CLK1 or the second DC voltage VGL less than the first DC voltage VGH to the second node Q2 based on the first clock signal CLK1 and the signal of the first node Q1. The second node controller 342 may include a fourth switching element M4 and a fifth switching element M5.

The fourth switching element M4 may include a gate electrode receiving the signal of the first node Q1, a first electrode receiving the first clock signal CLK1, and a second electrode electrically connected to the second node Q2. The fifth switching element M5 may include a gate electrode receiving the first clock signal CLK1, a first electrode receiving the second DC voltage VGL, and a second electrode electrically connected to the second node Q2.

The first output buffer 343 may output the Nth carry signal CRY[n] based on the signal of the first node Q1 and a signal of the second node Q2.

The first out buffer 343 may include a first pull-up switching element M6-1 and a first pull-down switching element M7-1. The first pull-up switching element M6-1 may include a gate electrode electrically connected to the second node Q2, a first electrode receiving a pull-up voltage (or the first DC voltage VGH), and a second electrode electrically connected to the carry terminal CRY outputting the Nth carry signal CRY[n]. The first pull-down switching element M7-1 may include a gate electrode electrically connected to the first node Q1, a first electrode electrically connected to the carry terminal CRY, and a second electrode receiving the second clock signal CLK2. The first output buffer 343 may further include a capacitor C2 of which a first terminal is electrically connected to the first electrode of the first pull-up switching element M6-1 and of which a second terminal is electrically connected to the gate electrode of the first pull-up switching element M6-1. The first output buffer 343 may further include a capacitor C1 of which a first terminal is electrically connected to the first electrode of the first pull-down switching element M7-1 and of which a second terminal is electrically connected to the gate electrode of the first pull-down switching element M7-1.

The output controller 344 may transfer the signal of the first node Q1 to a third node Q3 based on the output enable signal OE and may transfer the signal of the second node Q2 to a fourth node Q4 based on the output enable signal OE. The output controller 344 may include a third control switching element M11 and a fourth control switching element M12. The third control switching element M11 may include a gate electrode receiving the output enable signal OE, a first electrode electrically connected to the first node Q1, and a second electrode electrically connected to the third node Q3. The third control switching element M11 may electrically connect the first node Q1 and the third node Q3 based on the output enable signal OE. The fourth control switching element M12 may include a gate electrode receiving the output enable signal OE, a first electrode electrically connected to the second node Q2, and a second electrode electrically connected to the fourth node Q4. The fourth control switching element M12 may electrically connect the second node Q2 and the fourth node Q4 based on the output enable signal OE.

In an example embodiment, the output controller 344 may initialize the third node Q3 (or a signal of the third node Q3) and the fourth node Q4 (or a signal of the fourth node Q4) based on the output disable signal OEB. For example, when the output disable signal OEB has a low level (or a logic low level), the output controller 344 may provide the first DC voltage VGH to the third node Q3 and may provide the second DC voltage VGL to the fourth node Q4. Therefore, the Nth gate initialization signal GI[n] output from the output terminal OUT may be maintained to have a high level (or a logic high level). In an example embodiment, the output controller 344 may include a first control switching element M9 and a second control switching element M10.

The first control switching element M9 may include a gate electrode receiving the output disable signal OEB, a first electrode receiving the first DC voltage VGH, and a second electrode electrically connected to the third node Q3. The second control switching element M10 may include a gate electrode receiving the output disable signal OEB, a first electrode receiving the second DC voltage VGL, and a second electrode electrically connected to the fourth node Q4.

The output controller 344 may further include a third capacitor C3 of which a first terminal is electrically connected to the first electrode of the first pull-down switching element M7-1 and of which a second terminal is electrically connected to the second node Q2.

The second output buffer 345 may output the Nth gate initialization signal GI[n] based on the signal of the third node Q3 and the signal of the fourth node Q4. The second output buffer 345 may include a second pull-up switching element M6-2 and a second pull-down switching element M7-2. The second pull-up switching element M6-2 may include a gate electrode electrically connected to the fourth node Q4, a first electrode receiving the pull-up voltage (e.g., VGH), and a second electrode electrically connected to the output terminal OUT outputting the gate initialization signal GI[n]. The second pull-down switching element M7-2 may include a gate electrode electrically connected to the third node Q3, a first electrode electrically connected to the output terminal OUT, and a second electrode receiving the second clock signal CLK2.

As described above, the first output block 340 may generate the Nth carry signal CRY[n] based on the N−1th carry signal CRY[n−1] and may generate the Nth gate initialization signal GI[n], which is different from the Nth carry signal CRY[n], based on the N−1th carry signal CRY[n−1], the output enable signal OE, and the output disable signal OEB. Therefore, the first output block 340 of the Nth stage may output the Nth carry signal CRY[n] based on the output enable signal OE and the output disable signal OEB, and the first output block 340 of the N+1th stage may be operated normally based on the Nth carry signal CRY[N].

Figure 4:
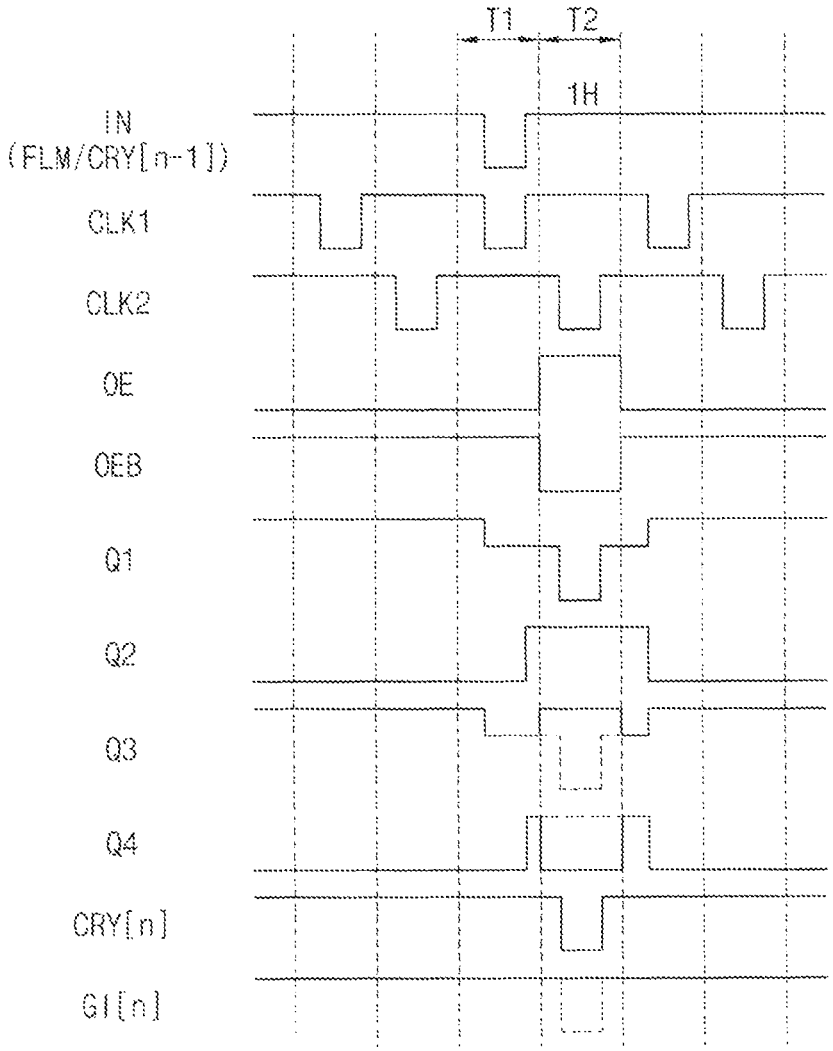
FIG. 4 is a timing diagram illustrating an operation of the first output block of FIG. 3.

FIG. 4 is a timing diagram illustrating an operation of the first output block of FIG. 3.

Referring to FIGS. 3 and 4, the first clock signal CLK1 may have a period that is the same as a period of the second clock signal CLK2, and the second clock signal CLK2 may be a shifted signal by a half period (or, a horizontal time) with respect to the first clock signal CLK1.

In a first period T1, the first clock signal CLK1 may have a logic low level (or a logical low level, the second DC voltage VGL, a turn-on voltage), and the second clock signal CLK2 may have a logic high level (or a logical high level, the first DC voltage VGH, a turn-off voltage). The input signal CRY[n−1] may have the logic low level. The output enable signal OE may have the logic low level, and the output disable signal OEB may have the logic high level.

The first control switching element M1 may be turned-on in response to the first clock signal CLK1 and may transfer the input signal CRY[n−1] to the first node Q1. Therefore, the first node Q1 may have the logic low level according to the input signal CRY[n−1].

The first pull-down switching element M7-1 may be turned on in response to a signal of the first node Q1 and may pull down the Nth carry signal CRY[n] to be equal to the second clock signal CLK2. Because the second clock signal CLK2 has the logic high level, the Nth carry signal CRY[n] may have the logic high level.

The first capacitor C1 may store a voltage difference between the logic high level and the logic low level according to the signal of the first node Q1 and the Nth carry signal CRY[n].

The fifth switching element M5 may be turned on in response to the first clock signal CLK1 and may transfer the second DC voltage VGL to the second node Q2. Therefore, the second node Q2 may have the second DC voltage VGL (or the logic low level).

The third control switching element M11 may be turned on in response to the output enable signal OE, and the fourth control switching element M12 may be turned on in response to the output enable signal OE. Therefore, the third node Q3 may have the logic high level, which is the same as the signal of the first node Q1, and the fourth node Q4 may have the logic low level, which is the same as the signal of the second node Q2.

Here, the second pull-up transistor M6-2 may be turned on, and the second pull-down transistor M7-2 may be turned off. Therefore, the Nth gate initialization signal GI[n] may have the logic high level.

That is, in the first period T1, the first output block 340 may prepare to output the Nth carry signal CRY[n] and the Nth gate initialization signal GI[n].

In a second period T2, the first clock signal CLK1 may have the logic high level, and the second clock signal CLK2 may have the logic low level. The output enable signal OE may have the logic high level, and the output disable signal OEB may have the logic low level.

Because the first node Q1 has logic low level due to the first capacitor C1, the first pull-down switching element M7-1 may be maintained in a turn-on state in response to the signal of the first node Q1. Therefore, the Nth carry signal CRY[n] may have the logic low level according to the second clock signal CLK2. The first node Q1 may have a voltage level (e.g., a second logic low level) that is lower than the logic low level by a bootstrap of the first capacitor C1.

The fourth switching element M4 may be turned on in response to the signal of the first node Q1 and may transfer the first clock signal CLK1 to the second node Q2. Therefore, the second node Q2 may have the logic high level according to the first clock signal CLK1 having the logic high level.

The third control switching element M11 may be turned off in response to the output enable signal OE and may disconnect the first node Q1 and the third node Q3. The fourth control switching element M12 may be turned off in response to the output enable signal OE and may disconnect the second node Q2 and the fourth node Q4.

The first control switching element M9 may be turned on in response to the output disable signal OEB and may transfer the first DC voltage VGH to the third node Q3. Therefore, the third node Q3 may have the first DC voltage VGH (or the logic high level). The second control switching element M10 may be turned on in response to the output disable signal OEB and may transfer the second DC voltage VGL to the fourth node Q4. Therefore, the fourth node Q4 may have the second DC voltage VGL (or the logic low level).

Here, the second pull-up transistor M6-2 may be turned on in response to the signal of the fourth node Q4, and the second pull-down transistor M7-2 may be turned off in response to the signal of the third node Q3. Therefore, the Nth gate initialization signal GI[n] may have the first DC voltage VGH (or the logic high level).

That is, in the second period T2, the first output block 340 may output the Nth carry signal CRY[n] having the logic low level and may output the Nth gate initialization signal having the logic high level.

The first output block 340 of the next stage (e.g., the N+1th stage) may be operated normally based on the Nth carry signal CRY[n].

As described above, the first output block 340 may output the Nth carry signal CRY[n] based on the input signal CRY[n−1] and may output the Nth gate initialization signal GI[n] based on the input signal CRY[n−1], the output enable signal OE, and the output disable signal OEB independently of the Nth carry signal CRY[n].

Figure 5:
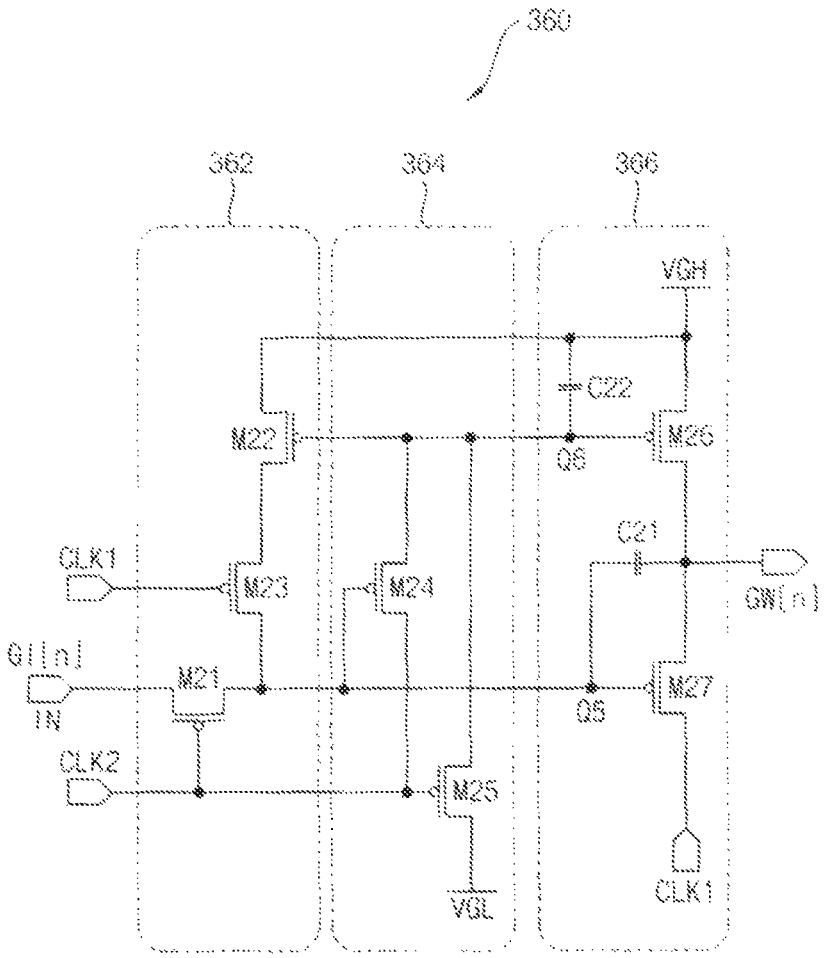
FIG. 5 is a circuit diagram illustrating an example of a second output block included in the gate driver of FIG. 2.

FIG. 5 is a circuit diagram illustrating an example of a second output block included in the gate driver of FIG. 2.

Referring to FIGS. 2 and 5, the second output block 360 included in the Nth stage may include a fifth node controller 362, a sixth node controller 364, and a third output buffer 366.

The first clock signal CLK1 and the second clock signal CLK2 may be provided to the second output block 340 in a reverse order with respect to the first output block 340. Therefore, the Nth gate signal GW[n] may be shifted by a horizontal time with respect to the Nth gate initialization signal GI[n].

The second output block 360 may receive the Nth gate initialization signal GI[n] and may output the Nth gate signal GW[n], which is shifted by a horizontal time with respect to the Nth gate initialization signal GI[n], dependently on the Nth gate initialization signal GI[n].

The fifth node controller 362 may transfer the Nth gate initialization signal GI[n] or the first DC voltage VGH to the fifth node Q5 based on the first and second clock signals CLK1 and CLK2. The fifth node controller 362 may include a twenty-first switching element M21, a twenty-second switching element M22, and a twenty-third switching element M23. The fifth node controller 362 may be the same as or substantially the same as the first node controller 341 of the first output block 340. Therefore, duplicated description will not be repeated.

The sixth node controller 364 may transfer the second DC voltage VGL or the second clock signal CLK2 to a sixth node Q6 based on the second clock signal CLK2 and the signal of the fifth node Q5. The sixth node controller 364 may include a twenty-fourth switching element M24 and a twenty-fifth switching element M25.

The sixth node controller 364 may be the same as or substantially the same as the second node controller 342 of the first output block 340. Therefore, duplicated description will not be repeated.

The third output buffer 366 may output the Nth gate signal GW[n] based on the signal of the fifth node Q5 and the signal of the sixth node Q6. The third output buffer 366 may include a third pull-up switching element M26 and a third pull-down switching element M27. The third output buffer 366 may further include capacitors C21 and C22, which are respectively connected to the third pull-up switching element M26 and the third pull-down switching element M27.

The third output buffer 366 may be the same as or substantially the same as the first output buffer 345 of the first output block 340. Therefore, duplicated description will not be repeated.

That is, the second output block 360 may output the Nth gate signal GW[n], which is shifted by a horizontal time with respect to the Nth gate initialization signal GI[n].

Figure 6:
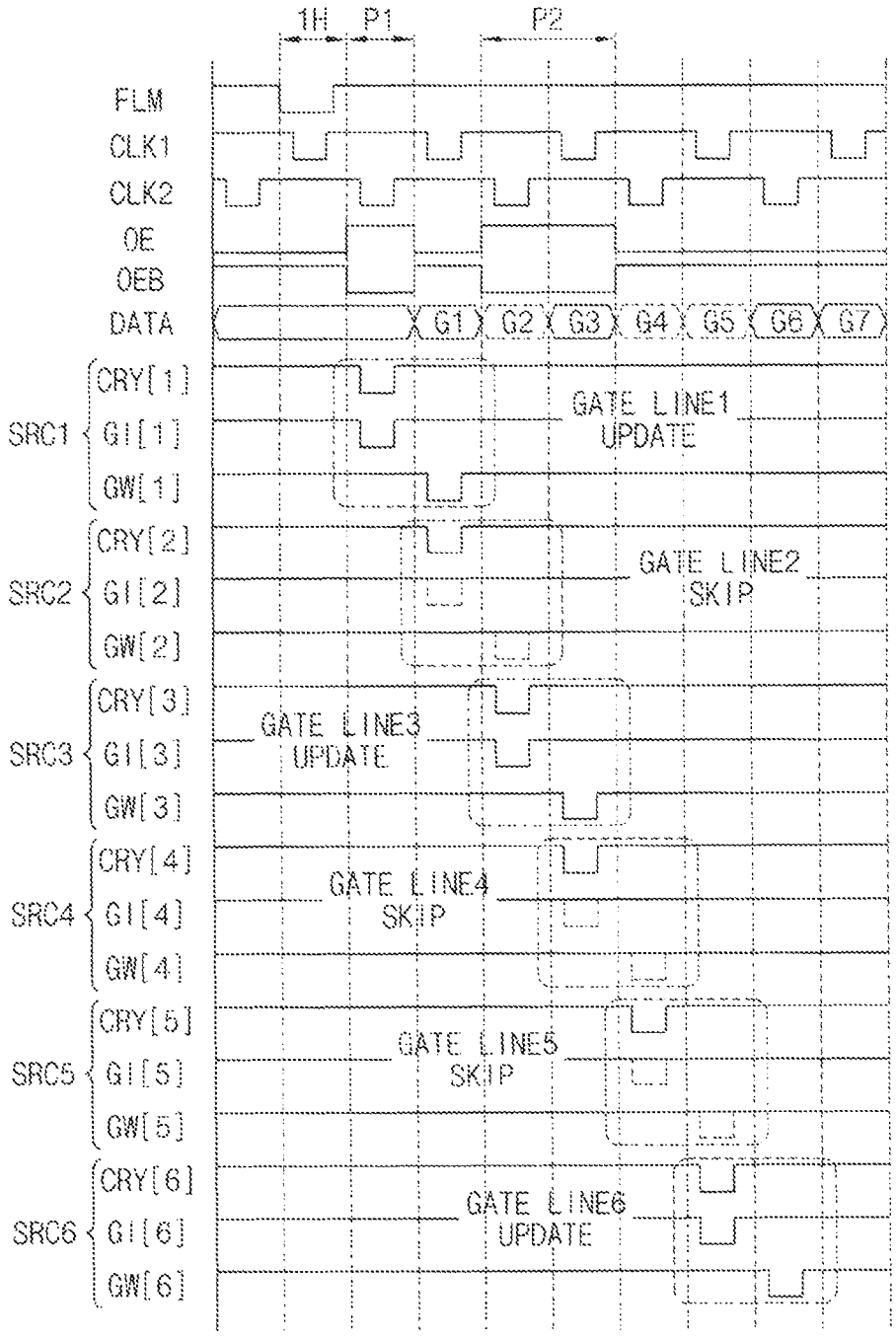
FIG. 6 is a timing diagram illustrating an operation of the gate driver of FIG. 2.

Referring to FIGS. 2 and 6, the gate driver 300 may selectively output a gate initialization signal and a gate signal based on the output enable signal OE and the output disable signal OEB.

The stages may sequentially output carry signals CRY[1] through CRY[6], gate initialization signals GI[1] through GI[6], and gate signals GW[1] through GW[6] when the frame start signal FLM having a logic low level is provided to the first stage SRC1. Each of the stages may simultaneously output the carry signals CRY[1] through CRY[6] and the gate initialization signals GI[1] through GI[6]. Because an output of the second output block 360 is dependent on an output of the first output block 340, the gate signals GW[1] through GW[6] output from the second output block 360 may be delayed (or shifted) by a horizontal time with respect to the carry signals CRY[1] through CRY[6] and the gate initialization signals GI[1] through GI[6].

In an example embodiment, the Nth gate initialization signal and gate signal may be skipped when the Nth stage receives the input signal having a logic low level during a high level period of the output enable signal OE. For example, as illustrated in FIG. 6, the output enable signal OE having a logic high level and the output disable signal OEB having a logic low level may be provided to the gate driver 300 in a first period P1 and a second period P2.

In the first period P1, the first carry signal CRY[1] may be generated by the first stage SRC1 and may be provided to the second stage SRC2. Here, the first output block 340 of the second stage SRC2 may output a second gate initialization signal GI[2] having a logic high level. The second output block 360 may receive the second gate initialization signal GI[2] and may output a second gate signal GW[2] having a logic high level. Therefore, a second gate initialization signal GI[2] and a second gate signal GW[2] may be skipped.

In the second period P2, the third carry signal CRY[3] may be generated by the third stage SRC3 and may be provided to the fourth stage SRC4. The fourth carry signal CRY[4] may be generated by the fourth stage SRC4 and may be provided to the fifth stage SRC5. Similarly to the first period P1, fourth and fifth gate initialization signals GI[4] and GI[5] and fourth and fifth gate signals GW[4] and GW[5] may be skipped according to the output enable signal OE having a logic high level and the output disable signal OEB having a logic low level.

Because generation of the carry signals is not dependent on the output enable signal OE, the carry signals may be outputted from all stages. Therefore, the gate initialization signal and the gate signal may be outputted in response to the carry signals of previous stages in other periods except of the first and second periods P1 and P2.

As described above, the gate driver 300 according to example embodiments may include the first output block 340 generating a carry signal independently and selectively outputting a gate initialization signal GI based on the output enable signal OE and the output disable signal OEB; and a second output block 360 outputting a gate signal GW dependently to the gate initialization signal GI. Therefore, some gate initialization signals and some gate signals may be selectively skipped.

Therefore, a partial driving of display panel 100 and a partial displaying may be easier, and a swing frequency of output of driver according to a change of an image may be reduced such that power consumption of the display device 1000 may be reduced.

Figure 7:
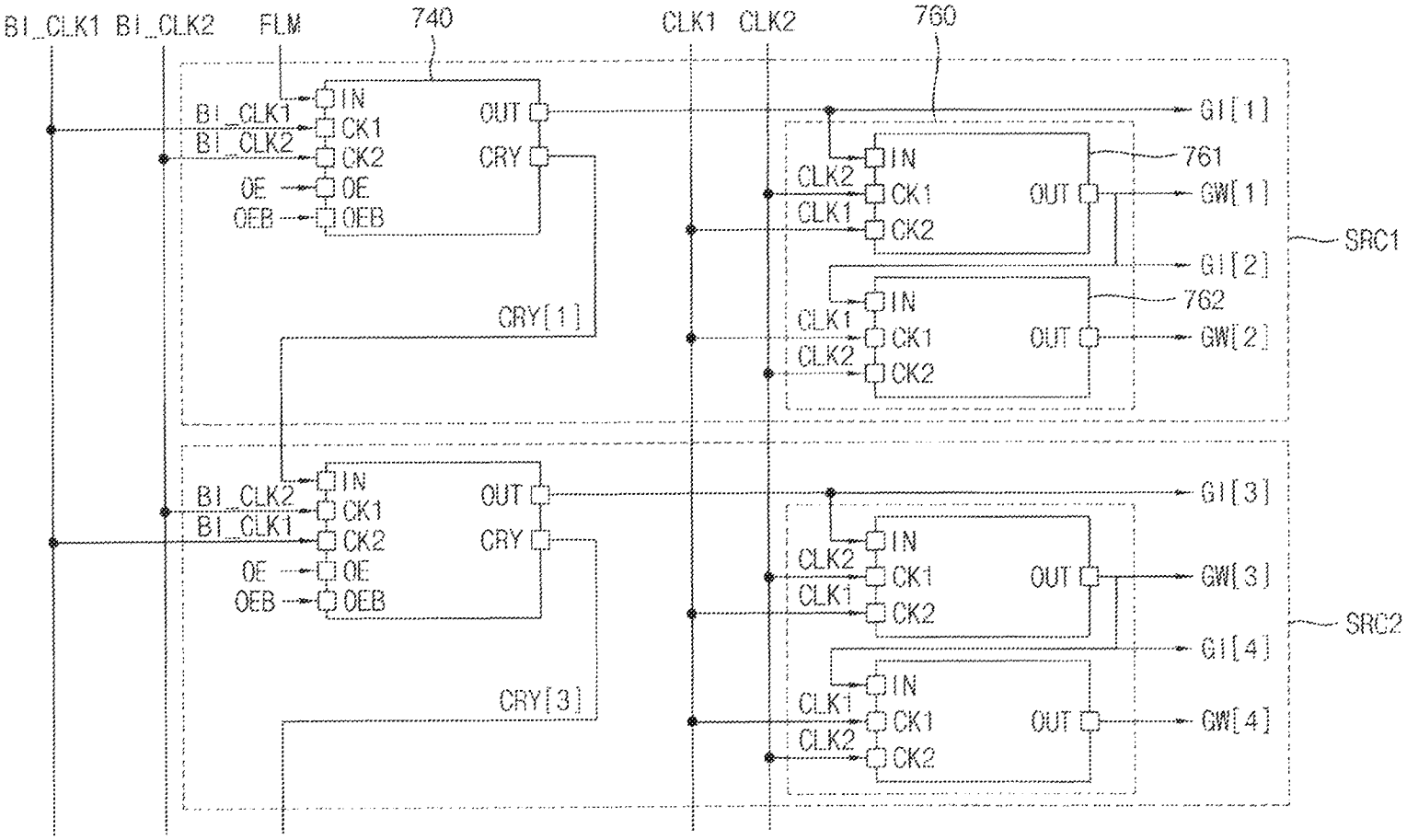
FIG. 7 is a block diagram illustrating an example of the gate driver included in the display device of FIG. 1.

FIG. 7 is a block diagram illustrating an example of the gate driver included in the display device of FIG. 1.

Referring to FIGS. 1 and 7, the gate driver 300 may include stages SRC1 and SRC2, which are electrically connected to each other dependently.

The stages SRC1 and SRC2 may be electrically connected to gate initialization lines and gate lines and may output gate initialization signals GI[1], GI[2], GI[3], and GI[4] and gate signals GW[1], GW[2], GW[3], and GW[4] to the above lines. Each of the stages SRC1 and SRC2 may be electrically connected to the gate initialization lines and gate lines. For example, each of the stages SRC1 and SRC2 may be electrically connected to M gate initialization lines and M gate lines, where M is an integer greater than or equal to 2.

Each of stages SRC1 and SRC2 may include a first output block 740 and a second output block 760. Each of the first block 740 and the second block 760 may include an input terminal IN, a first clock terminal CK1, a second clock terminal CK2, and an output terminal OUT. The first output block 740 may further include an enable terminal OE, disable terminal OEB, and a carry terminal CRY. Although not shown, the first output block 740 and the second output block 760 may further include terminals receiving a first DC current and a second DC current less than the first DC current.

A first block clock signal BI_CLK1 and a second block clock signal BI_CLK2 may be provided to the first output block 740. Here, the first block clock signal BI_CLK1 may have a period that is the same as a period of the second block clock signal BI_CLK2, and the second block clock signal BI_CLK2 may be a shifted signal by some time with respect to the first block clock signal BI_CLK1. The first block clock signal BI_CLK1 and second block clock signal BI_CLK2 may be provided in reverse to an adjacent stage.

The first output block 740 may output a carry signal based on an input signal (e.g., FLM and CRY[1]). The frame start signal FLM or a carry signal of a previous stage may be provided to the input terminal IN of the first output block 740. That is, the frame start signal FLM may be provided to the input terminal IN of the first output block 740 of the first stage SRC1, and the carry signal of the previous stage may be provided to the input terminal IN of the first output block 740 of the second through Nth stages. The carry terminal CRY of the first output block 740 may output the carry signal (e.g., CRY[1] and CRY[3]) to the first output block 740 of a next stage.

The first output block 740 may output an odd-numbered gate initialization signal (e.g., GI[1] and GI[3]) based on the input signal (e.g., FLM, CRY[1], and CRY[3]), the output enable signal OE, and the output disable signal OEB. The first output block 740 may be the same as or substantially the same as the first output block 340 described with reference to FIGS. 2 and 4. However, the first output block 740 illustrated in FIG. 7 may be operated based on the first block clock signal BI_CLK1 and the second block clock signal BI_CLK2 instead of the first clock signal CLK1 and the second clock signal CLK2. Therefore, duplicated description will not be repeated.

The second output block 760 may receive the odd-numbered gate initialization signal (e.g., GI[1] and GI[3]) and may output an odd-numbered gate signal (e.g., GW[1] and GW[3]), which is delayed by a horizontal time with respect to the odd-numbered gate initialization signal (e.g., GI[1] and GI[3]). In addition, the second output block 760 may output an even-numbered gate signal (e.g., GW[2] and GW[4]), which is delayed by a horizontal time with respect to the odd-numbered gate signal (e.g., GW[1] and GW[3]). The second output block 760 may output the even-numbered gate initialization signal (e.g., GI[2] and GI[4]), which is the same as the odd-numbered gate signal GW[1] and GW[3].

In an example embodiment, the second output block 760 may include a first sub output block 761 and a second sub output block 762. The first sub output block 761 may generate the odd-numbered gate signal (e.g., GW[1] and GW[3]) by shifting the odd-numbered gate initialization signal (e.g., GI[1] and GI[3]) by a horizontal time. The first sub output block 761 may output the even-numbered gate initialization signal GI[2] and GI[4], which are the same as the odd-numbered gate signal (e.g., GW[1] and GW[3]). The second sub output block 762 may generate the even-numbered gate signal GW[2] and GW[4] by shifting the odd-numbered gate signal GW[1] and GW[3] by a horizontal time.

The first sub output block 761 may be the same as or substantially the same as the second output block 360 as described with reference to FIGS. 2 and 5. The second sub output block 762 may be the same as or substantially the same as the second output block 360 as described with reference to FIGS. 2 and 5. Therefore, duplicated description will not be repeated.

As described above, the gate driver 300 according to example embodiments may selectively update an image for each block, which includes pixel rows, by including stages that generate gate signals and gate initialization signals.

It is illustrated in FIG. 7 that the second output block 760 includes the first and second sub output blocks 761 and 762. However, the second output block 760 is not limited thereto. For example, the second output block 760 may include M sub output blocks, which are electrically connected to each other dependently. Here, the output block 740 may be operated based on the first and second block clock signals BI_CLK1 and BI_CLK2, which have a period of M*2.

Figure 8:
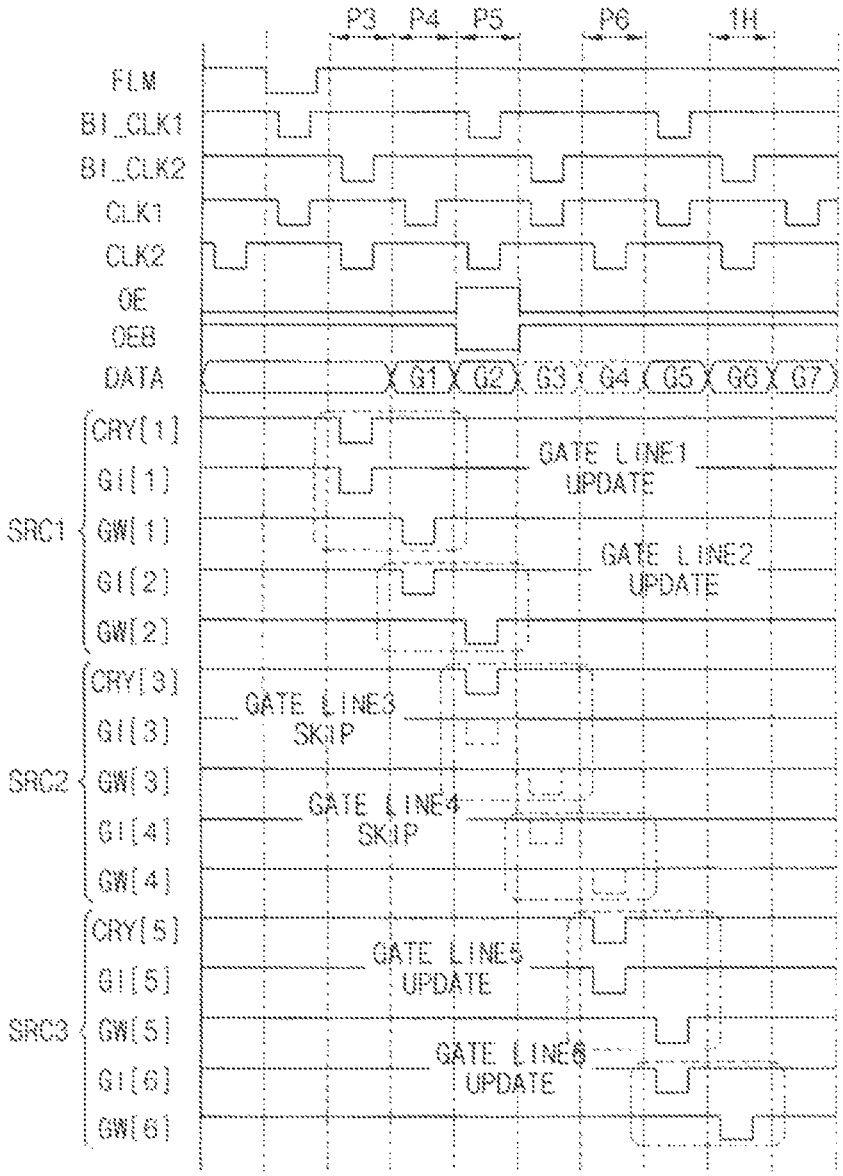
FIG. 8 is a timing diagram illustrating an operation of the gate driver of FIG. 7.

FIG. 8 is a timing diagram illustrating an operation of the gate driver of FIG. 7.

Referring to FIGS. 6 through 8, the gate driver 300 may selectively output the gate initialization signals and the gate signals for each block, which includes pixel rows, based on the output enable signal OE and the output disable signal OEB.

The first block clock signal BI_CLK1 may have an operation period of 3 horizontal times (3H), and the second block clock signal BI_CLK2 may have an operation period of 3 horizontal times (3H).

In a third period P3, the first stage SRC1 may generate a first carry signal CRY[1] having a logic low level and a first gate initialization signal GI[1]. The first carry signal CRY[1] may be provided to the second stage SRC2.

In a fourth period P4, the first stage SRC1 may output the first gate signal GW[1] and the second gate initialization signal GI[2] based on the first gate initialization signal GI[1]. The second stage SRC2 may receive the first carry signal CRY[1] having the logic low level but may not operate according to the first and second block clock signal BI_CLK1 and BI_CLK2.

In a fifth period P5, the second stage SRC2 may generate a third carry signal CRY[3] based on the first carry signal CRY[1]. Because the output enable signal OE has the logic high level, and because the output disable signal OEB has the logic low level, the second stage SRC2 may skip the output of (i.e., not output) the third gate initialization signal GI[3].

The second stage SRC2 may skip the output of the third gate signal GW[3], the fourth gate initialization GI[4], and the fourth gate signal GW[4] according to the third gate initialization signal GI[3].

In a sixth period P6, the third stage SRC3 may generate a fifth carry signal CRY[5] and a fifth gate initialization signal GI[5] based on the third carry signal CRY[3]. After this, the third stage SRC3 may output a fifth gate signal GW[5], a sixth gate initialization signal GI[6], and a sixth gate signal GW[6], which are dependent on the fifth gate initialization signal GI[5].

As described above, the gate driver 300 according to example embodiments may include the first block 360 dependently generating a carry signal and selectively outputting a gate initialization signal GI based on the output enable signal OE and the output disable signal OEB; and a second output block 360 outputting a gate signal GW for each block, which includes pixel rows, dependently on the gate initialization signal GI. Therefore, the gate driver 300 may selectively skip some gate initialization signals and some gate signals.

The present inventive concept may be applied to any display device (e.g., an organic light emitting display device, a liquid crystal display device, etc) including a gate driver. For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A gate driver comprising stages configured to output gate signals and gate initialization signals, wherein an Nth stage (where N is a positive integer) includes:

a first output block configured to generate an Nth carry signal based on an N−1th carry signal and to generate an Nth gate initialization signal based on the N−1th carry signal, an output enable signal, and an output disable signal that is an inverted signal of the output enable signal; and a second output block configured to generate an Nth gate signal by shifting the Nth gate initialization signal by a horizontal time.

2. The gate driver of claim 1, wherein the stages selectively output the gate signals and the gate initialization signals based on the output enable signal and the output disable signal.

3. The gate driver of claim 1, wherein the first output block includes:

a first node controller transferring the N−1th carry signal or a first direct current (DC) voltage to a first node based on a first clock signal and a second clock signal;

a second node controller transferring a second DC voltage or the first clock signal to a second node based on the first clock signal and a signal of the first node, the second DC voltage being lower than the first DC voltage;

a first output buffer outputting the Nth carry signal based on a signal of the first node and a signal of the second node;

an output controller transferring a signal of the first node to a third node based on the output enable signal and transferring a signal of the second node to a fourth node based on the output enable signal; and a second output buffer outputting the Nth gate initialization signal based on a signal of the third node and a signal of the fourth node.

4. The gate driver of claim 3, wherein the output controller initializes the third node and the fourth node based on the output disable signal.

5. The gate driver of claim 4, wherein the output controller provides the first DC voltage to the third node and provides the second DC voltage to the fourth node when the output disable signal has a logic low level.

6. The gate driver of claim 5, wherein the output controller includes:

a first control switching element including a gate electrode receiving the output disable signal, a first electrode receiving the first DC voltage, and a second electrode electrically connected to the third node; and a second control switching element including a gate electrode receiving the output disable signal, a first electrode receiving the second DC voltage, and a second electrode electrically connected to the fourth node.

7. The gate driver of claim 6, wherein the Nth stage skips the output of the Nth gate initialization signal and the Nth gate signal in response to the output disable signal having a logic low level.

8. The gate driver of claim 6, wherein the output controller includes:

a third control switching element electrically connecting the first node and the third node based on the output enable signal; and a fourth control switching element electrically connecting the second node and the fourth node based on the output enable signal.

9. The gate driver of claim 8, wherein the output controller includes:

a third capacitor electrically connected between an output terminal of the first output buffer and the third node.

10. The gate driver of claim 3, wherein the first output buffer includes:

a first pull-up switching element including a gate electrode electrically connected to the second node, a first electrode receiving a pull-up voltage, and a second electrode electrically connected to an output terminal that outputs the Nth carry signal; and a first pull-down switching element including a gate electrode electrically connected to the first node, a first electrode electrically connected to the output terminal, and a second electrode receiving the second clock signal.

11. The gate driver of claim 3, wherein the second output buffer includes:

a second pull-up switching element including a gate electrode electrically connected to the fourth node, a first electrode receiving a pull-up voltage, and a second electrode electrically connected to an output terminal that outputs the Nth gate initialization signal; and a second pull-down switching element including a gate electrode electrically connected to the third node, a first electrode electrically connected to the output terminal, and a second electrode receiving the second clock signal.

12. The gate driver of claim 1, wherein the N−1th carry signal is a frame start signal.

13. A gate driver comprising stages configured to output gate signals and gate initialization signals, wherein an Nth stage (where N is a positive integer) includes:

a first output block configured to generate a 2N−1th carry signal based on a 2N−3th carry signal and to generate a 2N−1th gate initialization signal based on the 2N−3th carry signal, an output enable signal, and an output disable signal that is an inverted signal of the output enable signal; and a second output block configured to generate a 2N−1th gate signal by shifting the 2N−1th gate initialization signal by a horizontal time and to generate a 2N gate signal by shifting the 2N−1th gate signal by a horizontal time.

14. The gate driver of claim 13, wherein the stages selectively output the gate signals and the gate initialization signals based on the output enable signal and the output disable signal.

15. The gate driver of claim 13, wherein the second output block outputs a 2N gate initialization signal that is the same as the 2N−1th gate signal.

16. The gate driver of claim 13, wherein the second output block includes:

a first sub output block generating the 2N−1th gate signal by shifting the 2N−1th gate initialization signal by a horizontal time; and a second sub output block generating the 2Nth gate signal by shifting the 2N−1th gate signal by a horizontal time.

17. The gate driver of claim 13, wherein the first output block includes:

a first node controller transferring the 2N−3th carry signal or a first direct current (DC) voltage to a first node based on a first block clock signal and a second block clock signal;

a second node controller transferring a second DC voltage or the first block clock signal to a second node based on the first block clock signal and a signal of the first node, the second DC voltage being lower than the first DC voltage;

a first output buffer outputting the 2N−1th carry signal based on a signal of the first node and a signal of the second node;

an output controller transferring a signal of the first node to a fourth node based on the output enable signal and transferring a signal of the second node to a third node based on the output enable signal; and a second output buffer outputting the 2N−1th gate initialization signal based on a signal of the third node and a signal of the fourth node.

18. The gate driver of claim 17, wherein the output controller provides the first DC voltage to the third node and provides the second DC voltage to the fourth node when the output disable signal has a logic low level.

19. The gate driver of claim 17, wherein the Nth stage skips the output of the 2N−1th and 2Nth gate initialization signals and the 2N−1th and 2Nth gate signals in response to the output disable signal having a logic low level.

20. A display device comprising:

a display panel including pixels;

a data driver configured to provide data signals to the display panel through data lines; and a gate driver including stages configured to provide gate signals and gate initialization signals to the display panel through gate lines and gate initialization lines, wherein an Nth stage (where N is a positive integer) includes:

a first output block configured to generate an Nth carry signal based on an N−1th carry signal and to generate an Nth gate initialization signal based on the N−1th carry signal, an output enable signal, and an output disable signal that is an inverted signal of the output enable signal; and a second output block configured to generate an Nth gate signal by shifting the Nth gate initialization signal by a horizontal time.

* * * * *